US005386279A

United States Patent [19]

Fukami et al.

[11] Patent Number: 5,386,279

[45] Date of Patent: Jan. 31, 1995

[54] TRANSFER DEVICE IN AN IMAGE-FORMING APPARATUS

[75] Inventors: Toshiyuki Fukami; Masashi Tanaka, both of Osaka, Japan

[73] Assignee: Mita Industrial Co., Ltd., Osaka, Japan

[21] Appl. No.: 202,365

[22] Filed: Feb. 25, 1994

[30] Foreign Application Priority Data

Feb. 26, 1993 [JP] Japan ..... 5-038997

[51] Int. Cl.[6] ..... G03G 15/16

[52] U.S. Cl. ..... 355/271; 492/53; 492/56

[58] Field of Search ..... 355/271, 272–276; 492/56, 53, 49, 28; 430/126

[56] References Cited

U.S. PATENT DOCUMENTS

| | | | |
|---|---|---|---|
| 4,998,143 | 3/1991 | Kumasaka et al. | 355/271 |
| 5,103,265 | 4/1992 | Kohyama | 355/269 |
| 5,122,838 | 6/1992 | Kohyama | 355/269 |
| 5,146,285 | 9/1992 | Kikuchi et al. | 355/270 |
| 5,148,219 | 9/1992 | Kohyama | 355/219 |
| 5,217,838 | 6/1993 | Wilson et al. | 430/126 |
| 5,241,343 | 8/1993 | Nishio | 355/219 |
| 5,250,357 | 10/1993 | Wilson et al. | 428/425.8 |
| 5,259,990 | 11/1993 | Schlueter et al. | 428/36.9 |
| 5,264,902 | 11/1993 | Suwa et al. | 355/281 |
| 5,270,768 | 12/1993 | Murata | 355/219 |
| 5,286,566 | 2/1994 | Schlueter et al. | 428/413 |
| 5,286,570 | 2/1994 | Schlueter et al. | 428/423.1 |

OTHER PUBLICATIONS

Japanese Patent Abstracts, vol. 13, No. 454 (P944), Abs Pub Oct. 13, 1989 for Japanese Doc. 01-177063, pub Jul. 13, 1989.

Japanese Patent Abstracts, vol. 17, No. 277 (P1546), Abs Pub. May 27, 1993 for Japanese Doc 05-11636, pub Jan. 22, 1993.

Japanese Patent Abstracts, vol. 8, No. 22 (M272), Abs Pub Jan. 31, 1984 for Japanese Doc 58-181660, pub Oct. 24, 1983.

*Primary Examiner*—R. L. Moses

*Attorney, Agent, or Firm*—Sherman and Shalloway

[57] ABSTRACT

An image carrier of an organic photosensitive material containing a charge-generating agent and a charge-transporting agent, and a transfer roller using an electrically conducting polyurethane rubber composition which is so cured as to exhibit a rubber hardness of higher than 50° (JIS A), are disposed being spaced apart maintaining a small gap which is greater than the thickness of the transfer material enabling the toner to be transferred onto the transfer material. This makes it possible to prevent the occurrence of image defects such as white spots and the like, to form transferred image favorably and stably over an extended period of time maintaining a high density without fogging and consuming a small transfer current.

3 Claims, 3 Drawing Sheets

TRANSFER DEVICE IN AN IMAGE-FORMING APPARATUS

BACKGROUND OF THE INVENTION

1. Field of the Invention

The present invention relates to a transfer device for use in an electrostatic photo-processing (image-forming system) such as in an electrostatic copying machine, a printer, a facsimile and the like. More specifically, the invention relates to a transfer device which prevents the organic photosensitive material from being deteriorated by the use of a transfer roller.

2. Description of the Prior Art

In an image-forming apparatus based upon the electrostatic photo-processing, the toner image formed on an image carrier is transferred by passing a transfer material such as a paper between the image carrier and a transfer roller that is disposed being opposed thereto.

Japanese Laid-Open Patent Publication No. 77063/1989 discloses a transfer roller having a hardness of 30° (JIS A) or smaller that is employed for such a transfer device. That is, this transfer device uses a transfer roller of a low hardness to prevent the coagulation of the toner that exists on the surface of the image carrier and to facilitate the cleaning with ease.

Moreover, Japanese Laid-Open Patent Publication No. 200277/1989 discloses a transfer system using the same transfer roller as the one described above or a like transfer roller wherein an electric charge of a polarity opposite to that of the toner is fed to a transfer material in a state where there exists a gap with respect to the image carrier (photosensitive material) and, then, the transfer material is brought into contact with the image carrier.

It was found, however, that the organic photosensitive material is deteriorated when the transfer system using the above-mentioned transfer roller is adapted to the organic photosensitive material that contains a charge-generating agent and a charge-transporting agent.

That is, the transfer roller made of an electrically conducting polyurethane rubber composition exhibits excellent abrasion resistance, electric properties and ozone resistant properties. When this transfer roller is used for transferring the toner from the organic photosensitive material onto the transfer material, however, image defects such as white spots and the like occur due to deterioration of the organic photosensitive material.

SUMMARY OF THE INVENTION

The object of the present invention therefore is to provide a transfer device which is capable of forming favorably and stably transferred image over an extended period of time preventing the occurrence of the above-mentioned image defects.

According to the present invention, there is provided a transfer device in an image-forming apparatus which has an image carrier and a transfer roller, and permits a transfer material to pass therethrough so that the toner of the image carrier is transferred onto the transfer material, wherein said image carrier is an organic photosensitive material containing a charge-generating agent and a charge-transporting agent, said transfer roller is made of an electrically conducting polyurethane rubber composition which is so cured as to exhibit a rubber hardness of higher than 50° (JIS A), and said image carrier and said transfer roller are disposed being spaced apart maintaining a small gap which is greater than the thickness of the transfer material enabling the toner to be transferred onto the transfer material.

DETAILED DESCRIPTION OF THE INVENTION

Figure 1:
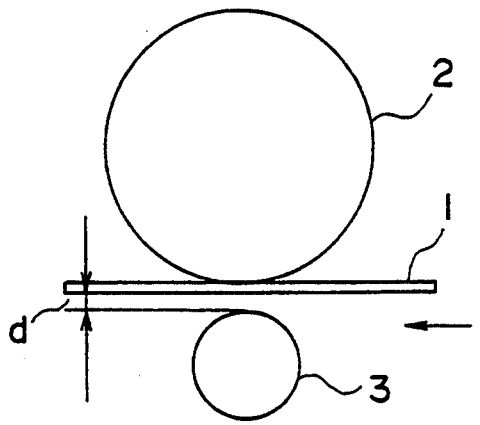
FIG. 1 is a diagram illustrating a system for bringing a transfer material into contact with a photosensitive material and a transfer roller.

The present invention uses, as an image carrier, an organic photosensitive material that contains a charge-generating agent and a charge-transporting agent. The function of the organic photosensitive material can be easily designed depending upon the combination of the charge-generating agent and the charge-transporting agent; i.e., the organic photosensitive material having a relatively high photosensitivity can be easily obtained maintaining a high level of safety at a reduced cost. Compared with the inorganic photosensitive materials, however, the organic photosensitive material tends to be contaminated and has a low surface hardness and low abrasion resistance.

On the other hand, a polyurethane rubber develops rubbery elasticity owing to the presence of soft segments based upon a polyester or a polyether in the polymer chain and hard segments based upon an aromatic chain bonded via an urethane or a urea bond. Therefore, the polyurethane rubber has excellent elastic properties such as a high degree of elastic recovery and low permanent distortion for an extended period of time. Moreover, since no ethylenical double bond is contained in the polymer chain, the polyurethane rubber is less likely to be deteriorated with ozone and, further, exhibits excellent electric properties without causing leakage, electric discharge or pinholes even when a high voltage is applied thereto.

However, when the transfer roller made of the electrically conducting polyurethane rubber is combined with the above-mentioned organic photosensitive material and the toner image is transferred onto the paper, image defects such as white spots and the like occur on the transferred image as mentioned earlier.

The present inventors have conducted keen study in order to prevent the occurrence of image defects, and have discovered the fact that the image defects such as white spots and the like can be effectively prevented when the polyurethane rubber used for the transfer roller is so cured as to exhibit a surface hardness of 50° or higher and, particularly, 70° or higher.

Reference should be made to Examples appearing later. That is, when the polyurethane rubber of the transfer roller has a hardness (JIS A) which is smaller than 50° (Comparative Examples 1 to 3), the white spots occur in the image after 1000 pieces of copies are obtained by using the transfer roller. When the hardness of the polyurethane rubber is increased to be 50° or higher, however, the white spots are prevented from occurring. Here, whether the rubber hardness is lower than 50° or higher than 50° is quite critical for the occurrence of the white spots.

it is considered that the white spots do not stem from the transfer of toner by the transfer roller but is caused by the mutual action between the transfer roller and the organic photosensitive material. This is because the white spots in the image do not take place during the initial stage of use of the transfer roller but occurs after the transfer roller is continuously used to some extent. Besides, after once occurred, the white spots permanently occur as far as the organic photosensitive material is used. That is, it is considered that since the transfer roller and the organic photosensitive material are directly opposed to each other except during the transfer of the toner, low-molecular components (such as unreacted monomer components and cracked components of polymers) in the polyurethane constituting the transfer roller migrate toward the organic photosensitive material to adversely affect the electrophotographic properties of the organic photosensitive material.

According to the present invention, the polyurethane rubber constituting the transfer roller has a hardness of 50° or higher and, particularly, 70° or higher to suppress the bleeding tendency of low-molecular photosensitive material-deteriorating components from the cured polyurethane. Moreover,the organic photosensitive material and the transfer roller are spaced apart maintaining a gap larger than the thickness of the transfer material in order to reduce the effect of the transfer roller upon the photosensitive material and, hence, to prevent the occurrence of the white spots on the image caused by the transfer roller.

According to the present invention, the organic photosensitive material is prevented from being worn out and the toner on the photosensitive material is not adversely affected even when the rubber has a hardness of 50° or higher because of the fact that a gap greater than the thickness of the transfer material is formed between the organic photosensitive material and the transfer roller, and that the photosensitive material and the transfer roller are prevented from coming into pressed contact with each other via the transfer material.

According to the present invention, furthermore, the toner is transferred from the surface of the photosensitive material onto the transfer material despite the formation of a gap larger than the thickness of the transfer material between the organic photosensitive material and the transfer roller. This is because when a proper transfer voltage is applied, an electric current necessary for transferring the toner is supplied despite the presence of the above-mentioned gap.

Figure 2:
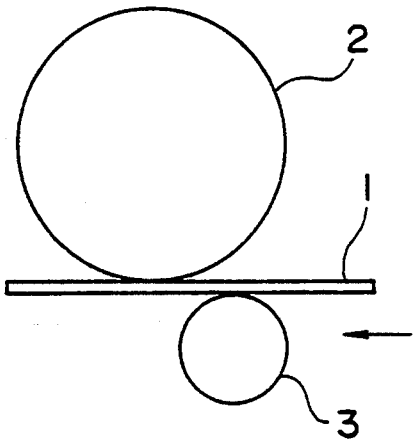
FIG. 2 is a diagram illustrating another system for bringing the transfer material into contact with the photosensitive material and the transfer roller.
Figure 3:
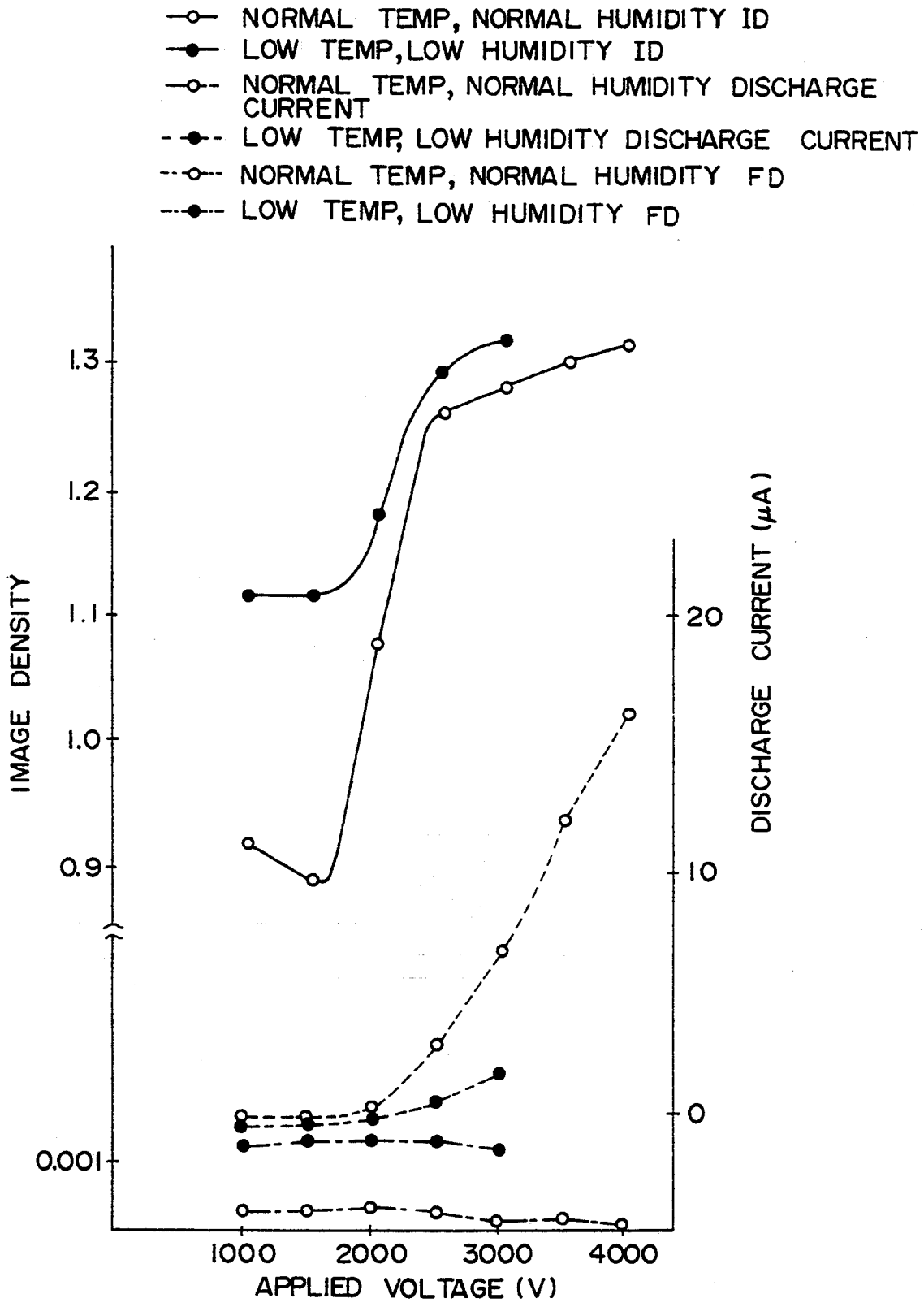
FIG. 3 is a graph showing relationships among voltages applied to the transfer roller, image densities ID (fogging densities FD) and discharge currents when the transfer material, photosensitive material and transfer roller are disposed as shown in FIG. 1.

The arrangement of the photosensitive material, transfer roller and the transfer material maintaining the above-mentioned gap may include the case shown in FIG. 1 where the transfer material 1 is brought into contact with the photosensitive material 2 only and a predetermined gap d is formed between the transfer roller 3 and the transfer material 1, and the case shown in FIG. 2 where the transfer material 1 comes into contact with the transfer roller 3 and then comes into contact with the photosensitive material 2. FIG. 3 shows relationships among the voltages applied to the transfer roller, image densities ID (fogging densities FD) and discharge currents when the transfer material, photosensitive material and transfer roller are arranged as shown in FIG. 1, from which it will be understood that the toner is effectively transferred when the applied voltage is proper. It will further be obvious that the transfer is effectively accomplished even when the current necessary for the transfer is about 3 uA which is very smaller than that of the case of the corona discharge (10 to 150 $\mu$A). In the case of FIG. 2, it needs not be pointed out that a current necessary for transferring the toner is supplied.

According to the present invention which employs the combination of the transfer roller of an electrically conducting polyurethane rubber composition and the organic photosensitive material containing the charge-generating agent and the charge-transporting agent as described above, use is made of the transfer roller which is so cured as to exhibit a rubber hardness of higher than 50° (JIS A) and a gap between the photosensitive material and the transfer roller is maintained to be greater than the thickness of the transfer material, in order to form a favorably and stably transferred image over an extended period of time while preventing the occurrence of image defects such as the white spots and the like. It is further allowed to form a transferred image of a high density without fogging consuming a small transfer current.

[Image-Forming Apparatus]

Figure 4:
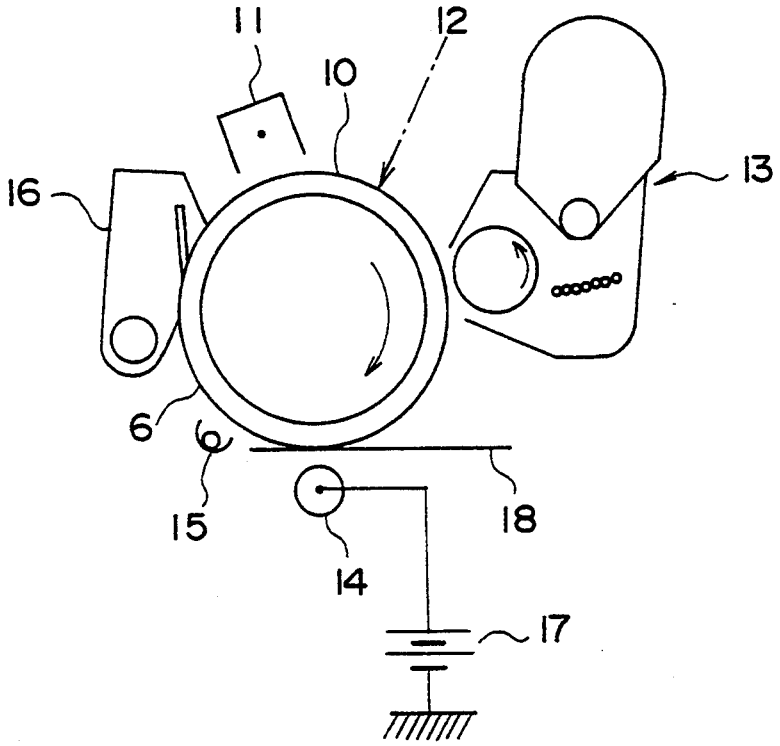
FIG. 4 is a diagram of arrangement for schematically illustrating an image-forming apparatus according to the present invention.

Referring to FIG. 4 schematically illustrating the image-forming apparatus according to the present invention, around a rotary photosensitive material drum 6 equipped with the above-mentioned organic photosensitive layer 10 are arranged a corona charger 11 for main charging, an optical system 12 for image exposure equipped with a light source of laser beam, a developer 13, a transfer roller 14, a light source 15 for discharging, and a device 16 for cleaning residual toner. To the transfer roller 14 is connected a DC power source 17 that applies a DC voltage of the same polarity as that of the corona charger 11.

In forming the image, the photosensitive layer 10 of the photosensitive material drum 6 is uniformly charged into a positive or a negative polarity by the corona charger 11. Due to this main charging, the surface potential of the photosensitive layer 10 is, usually, set to lie from 500 to 700 V in absolute value.

Then, the image is exposed to a laser beam from the optical system 12, the portion of the photosensitive layer 10 corresponding to the image of the document (i.e., the portion irradiated with the laser beam) assumes a potential of from 0 V to 100 V, the portion (background) not irradiated with the laser beam is held at a dark attenuation potential from the main charging potential, and electrostatic latent image is formed.

The electrostatic latent image is developed by the developer 13 and a toner image is formed on the surface of the photosensitive layer 10. The developing through the developer 13 is carried out based upon a magnetic brush developing method or a like method using a developing agent known per se., e.g., using a one-component type or a two-component type developing agent containing the toner that is charged to the same polarity as the main charging polarity of the photosensitive layer 10. That is, on the portion irradiated with the laser beam is formed the toner image that is charged to the same polarity as the main charging polarity. In this case, a suitable bias voltage is applied across the developer 13 and the photosensitive material drum 6 to efficiently carry out the developing like in the prior art.

The toner image formed on the surface of the photosensitive layer is transferred onto the transfer material such as a paper that has passed through between the transfer roller 14 and the photosensitive material drum 6. The photosensitive layer 10 is then discharged by the irradiation with light from the light source 15 for discharging.

After the above-mentioned transfer and discharge are carried out, the toner remaining on the photosensitive layer 10 is removed by the cleaning device 16, and the next image-forming cycle is carried out. The toner image transferred onto the transfer material is, as required, fixed to the transfer material by the application of heat or pressure.

[Transfer Roller]

The present invention uses, as a transfer roller, a roller made of an electrically conducting polyurethane rubber composition which is so cured as to exhibit a rubber hardness in excess of 50° (JIS A) and, preferably, in excess of 70°.

As pointed out already, the polyurethane rubber exhibits a rubbery elasticity owing to the presence of soft segments based on a polyester or a polyether in a polymer chain and hard segments based on an aromatic chain bonded via an urethane or a urea bond.

Polyurethane Rubber:

The polyurethane rubber used in the present invention is obtained by the reaction of a chain extender (crosslinking agent) with a polyurethane prepolymer (isocyanate-terminated polymer) that is obtained by reacting a polyol (hydroxyl group-terminated polymer) with a polyisocyanate compound. In the case of the linear type, the polyurethane rubber has a recurring chemical structure expressed by the following formula (1).

$$\left(YR_3YC\right)_m\underset{\underset{O}{\|}}{}NH\left(R_1NHC\underset{\underset{O}{\|}}{}OR_2OCNH\underset{\underset{O}{\|}}{}\right)_n R_1NHC\underset{\underset{O}{\|}}{} \quad (1)$$

wherein $R_1$ is a polyol residue, $R_2$ is a polyisocyanate residue, $R_3$ is a residue of a chain extender, Y is 0 or a group —NR— (R is a hydrogen atom or a monovalent organic group), m is zero or 1, and n is a number of 1 or greater.

In the recurring unit of the above formula (1), the polyol residue $R_1$ is a soft segment and the polyisocyanate residue $R_2$ is a hard segment. When the chain extender (crosslinking agent) is water, m becomes zero due to the decarboxylation reaction and when the chain extender is a low-molecular diol or diamine, m becomes 1.

The polyurethane is formed by the reaction of an isocyanate-terminated prepolymer represented by the following formula (2)

$$-OCN\left(R_1NHC\underset{\underset{O}{\|}}{}OR_2OCNH\underset{\underset{O}{\|}}{}\right)_n R_1-NCO- \quad (2)$$

with a chain extender represented by the following formula (3)

$$HYR_3YH \quad (3)$$

By adjusting the above reaction, a desired rubber hardness is obtained.

Figure 5:
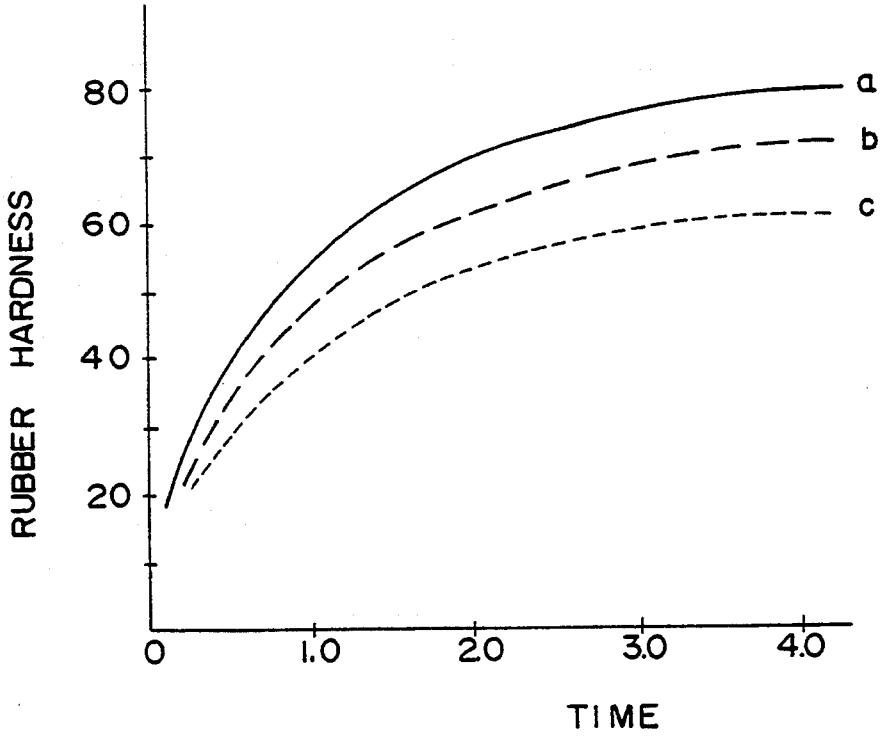
FIG. 5 is a diagram showing relationships between the reaction time of the compositions forming polyurethane rubbers and the hardness (JIS A) of the obtained rubber compositions.

The polyurethane having a desired hardness is obtained by adjusting, for example, the temperature and/or the reaction time of the chain-extending (crosslinking) reaction. FIG. 5 shows relationships between the reaction time and the rubber hardness of a polyurethane composition obtained in Example 1 appearing later of when the curing reaction is carried out at temperatures of 100° C., 150° C. and 200° C. (a: 200° C., b: 150° C., c: 100° C.), from which it will be understood that the rubber hardness increases with an increase in the temperature and an increase in the reaction time.

That is, the free isocyanate group in the prepolymer reacts with the chain extender (crosslinking agent) to form a urea bond which helps increase the molecular weight of the polyurethane, and further reacts with the existing urethane bond and urea bond to form an allophanate bond and a buret bond which help form a three-dimensional crosslinked structure contributing to increasing the rubber hardness, obtaining desired effects of the present invention and improving abrasion resistance, heat resistance and durability.

The polyol used for forming the prepolymer will have 2 or more, and preferably 2 to 3 active hydrogen atoms in a molecule. Examples of the polyol include a polyetherpolyol, a polyesterpolyol, a polyacrylpolyol, a polyvinylpolyol and the like which may be used in one kind or in two or more kinds. The polyesterpolyol is preferred from the standpoint of electric properties and durability, and the invention uses a widely known polyesterpolyol which has been used for the preparation of a polyester polyurethane.

Among them, a preferred polyesterpolyol comprises a diol and a dicarboxylic acid, and is obtained by suitably reacting at least one or more kinds of aliphatic diols with at least one or more kinds of aliphatic carboxylic acids. The polyesterpolyol may contain a polyester component obtained by, for example, ring-opening-polymerizing a polycaprolactam and the like.

Preferred examples of the aliphatic diol component include a 1,2-propanediol, a 1,3-propanediol, a 1,3-butanediol, a 1,4-butanediol, a 1,5-pentanediol, a 1,6-hexanediol, a 1,8-octanediol, a 1,10-decanediol, a neopentyl glycol, an ethylene glycol, a diethylene glycol, a polyethylene glycol, a dipropylene glycol, a polypropylene glycol, a 1,4-cyclohexanemethanol, a 1,4-cyclohexanediol, a 3-methyl-1,5-pentanediol, and the like.

Preferred examples of-the aliphatic carboxylic acid include a malonic acid, a succinic acid, a glutaric acid, an adipic acid, a pimelic acid, a suberic acid, an azelaic acid, a sebacic acid, a decanedicarboxylic acid, a dodecanedicarboxylic acid, a 1,3-cyclohexanedicarboxylic acid, a 1,4-cyclohexanedicarboxylic acid and the like.

It is desired that the hydroxyl group-terminated polymer has a number average molecular weight of from 300 to 10,000 and, particularly, from 1,000 to 8,000.

The polyisocyanate compound will be the widely known polyisocyanate compound used for the preparation of a polyurethane. Among them, it is desired to use a diisocyanate such as a tolylene diisocyanate, a 4,4-diphenylmethane diisocyanate, a xylylene diisocyanate, a naphthylene diisocyanate, a paraphenylene diisocyanate, a tetramethylxylene diisocyanate, a hexamethylene diioscyanate, a dicyclohexylmethane diisocyanate, an isophorone diisocyanate, and a tolidine diisocyanate. Particularly preferred examples include the 4,4-diphenylmethane diisocyanate, xylylene diisocyanate, isophorone diisocyanate and hexamethylene diisocyanate.

The polyurethane prepolymer is prepared by blending one or two or more kinds of polyols and one or two or more kinds of polyisocyanate compounds at an NCO/OH ratio of 1.1 to 4 and, more preferably, 1.3 to 2.5, and reacting them together at a temperature of 60° to 130° C. for several hours.

As the chain extender (crosslinking agent), there can be used polyfunctional active hydrogen-containing compounds such as low-molecular polyols, low-molecular polyamines and, particularly, aliphatic or aromatic polyamines.

Preferred examples of the chain extender (crosslinking agent) includes aliphatic diol components such as a 1,2-propane diol, a 1,3-propanediol, a 1,3-butanediol, a 1,4-butanediol, a 1,5-pentanediol, a 1,6-hexanediol, a 1,8-octanediol, a 1,10-decanediol, a neopentyl glycol, an ethylene glycol, a diethylene glycol, a polyethylene glycol, a dipropylene glycol, a polypropylene glycol, a 1,4-cyclohexanemethanol, a 1,4-cyclohexanediol and a 3-methyl-1,5-pentanediol.

Preferred examples of the aliphatic diamine component include a 1,2-propanediamine, a 1,3-propanediamine, a 1,3-butanediamine, a 1,4-butanediamine, a 1,5-pentanediamine, a 1,6-hexanediamine, a 1,8-octanediamine, a 1,10-decanediamine, a neopentyldiamine, an ethylenediamine, a 1,4-cyclohexanediamine, and a 3-methyl-1,5-pentanediamine.

Examples of the aromatic polyamine include a tolylenediamine, a 4,4-diphenylmethanediamine, a xylylenediamine, a naphthylenediamine, a paraphenylenediamine, a tetramethylxylenediamine, a dicyclohexylmethanediamine, an isophoronediamine and a tolidinediamine.

In order to obtain the polyurethane having a desired hardness, the chain-extending (crosslinking) reaction is carried out by selecting a temperature and a reaction time usually from a temperature range of from 100° C. to 300° C. and a reaction time range of from 0.5 to 5 hours.

The transfer roller 14 is made of a composition obtained by blending the polyurethane with an electrically conducting powder. The composition of the prepolymer and the chain extender (crosslinking agent) is blended with the electrically conducting powder prior to effecting the crosslinking, whereby the electrically conducting powder is homogeneously and uniformly blended and dispersed. It is desired that the electrically conducting rubber has a volume resistivity of, usually, from $10^7$ to $10^{14}$ Ω.cm and, particularly, from $10^8$ to $10^{12}$ Ω.cm.

As the electrically conducting powder, there can be used an electrically conducting carbon black, a tin oxide doped with indium or antimony, or a metal powder such as of copper, silver, aluminum and the like. Among them, however, the electrically conducting carbon black is preferred. It is desired that the electrically conducting powder is contained in an amount of from 5 to 70% by weight and, particularly, from 10 to 50% by weight per the whole amount.

In forming the electrically conducting rubber roller, it is allowable to blend widely known blending agents such as a crosslinking promoting agent, a softening agent, an anti-aging agent, a filler, a dispersing agent, a plasticizer and the like in known amounts.

It is desired that the transfer roller 14 is arranged maintaining a gap of, usually, from 0.2 to 2 mm and, particularly, from 0.3 to 1.0 mm with respect to the photosensitive material drum 6.

[Photosensitive Material]

The photosensitive material used in the present invention has a photosensitive layer which contains a charge-generating agent and a charge-transporting agent. The invention may use a laminated-type photosensitive material in which the charge-generating layer (CGL) and the charge-transporting layer (CTL) are provided on the electrically conducting substrate in the order mentioned or in a reverse order, or a photosensitive material in which the charge-generating agent and the charge-transporting agent are provided in the form of a single dispersion photosensitive layer on the electrically conducting substrate.

According to the present invention, it is desired that the organic photosensitive material has an organic photosensitive layer of the single dispersion type on the electrically conducting substrate and, particularly, that the organic photosensitive layer contains the charge-generating agent, electron-transporting agent and positive hole-transporting agent dispersed in the resin medium, from such a standpoint that it can be electrically charged into a positive polarity or a negative polarity as will be described later.

Examples of the charge-generating agent include selenium, selenium-tellurium, amorphous silicon, a pyrylium salt, an azo type pigment, a dis-azo type pigment, an anthanthrone type pigment, a phthalocyanine type pigment, an indigo type pigment, a threne type pigment, a toluidine type pigment, a pyrazoline type pigment, a perylene type pigment and a quinacridone type pigment, which will be used in one kind or being mixed two or more kinds so as to exhibit a wave-absorption band over a desired region.

Particularly preferred examples include an X-type metal-free phthalocyanine, an oxotitanyl phthalocyanine, a perylene type pigment, and, particularly, the one represented by the following general formula (4),

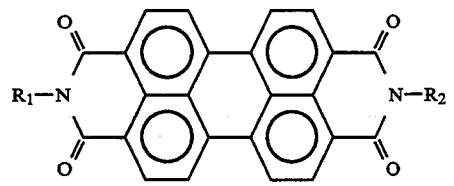

(4)

wherein $R_1$ and $R_2$ are substituted or unsubstituted alkyl groups with less than 18 carbon atoms, cycloalkyl groups, aryl groups, alkaryl groups or aralkyl groups.

Examples of the alkyl group may be an ethyl group, a propyl group, a butyl group, and a 2-ethylhexyl group, examples of the cycloalkyl group may be a cyclohexyl group and the like, examples of the aryl group may be a phenyl group and a naphthyl group, examples of the alkaryl group may be a tolyl group, a xylyl group and an ethylphenyl group, and examples of the aralkyl group may be a benzyl group and a phenetyl group.

Examples of the substituent are alkoxy group, a halogen atom and the like.

A variety of resins can be used as resin media for dispersing the charge-generating agent, such as olefin type polymers, e.g., a styrene type polymer, an acrylic polymer, a styrene-acrylic polymer, an ethylene-vinyl acetate copolymer, a polypropylene and an ionomer, as well as photo-curing type resins, e.g., a polyvinyl chloride, a vinyl chloride-vinyl acetate copolymer, a polyester, an alkyd resin, a polyamide, a polyurethane, an epoxy resin, a polycarbonate, a polyallylate, a polysulfone, a diallyl phthalate resin, a silicone resin, a ketone resin, a polyvinyl butyral resin, a polyether resin, a phenol resin and an epoxyacrylate. These binder resins can be used in a single kind or being mixed in two or more kinds. Preferred examples of the resin include the styrene type polymer, acrylic polymer, styrene-acrylic polymer, polyester, alkyd resin, polycarbonate and polyallylate.

Particularly preferred resin is a polycarbonate derived from bisphenols represented by the following general formula (5)

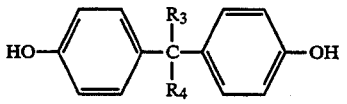

(5)

wherein $R_3$ and $R_4$ are hydrogen atoms or lower alkyl groups, and $R_3$ and $R_4$ being bonded together may form a cyclic ring such as a cyclohexane ring together with a bonded carbon atom, and a phosgene.

Any known electron-transporting agent having electron-transporting property can be used. Preferred examples include electron attractive substances such as a paradiphenoquinone derivative, a benzoquinone derivative, a naphthoquinone derivative, a tetracyanoethylene, a tetracyanoquinodimethane, a chloroanil, a bromoanil, a 2,4,7-trinitro-9-fluorenone, a 2,4,5,7-tetranitro-9-fluorenone, a 2,4,7-trinitro-9-dicyanomethylenefluorenone, a 2,4,5,7-tetranitroxanthone, a 2,4,8-trinitrothioxanthone, or those electron attractive substances having high molecular weights.

Among them, the paradiphenoquinone derivative and, particularly, an asymmetrical paradiphenoquinone derivative is preferred because of its excellent solubility and excellent electron-transporting property.

The invention uses the paradiphenoquinone derivative represented by the following general formula (6)

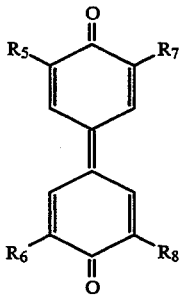

(6)

wherein $R_5$, $R_6$, $R_7$ and $R_8$ are hydrogen atoms, alkyl groups, cycloalkyl groups, aryl groups, aralkyl groups or alkoxy groups.

It is desired that $R_5$, $R_6$, $R_7$ and $R_8$ are substituents of asymmetrical structure, and two out of $R_5$, $R^6$, $R_7$ and $R_8$ are lower alkyl groups, and another two are branched-chain alkyl groups, cycloalkyl groups, aryl groups or aralkyl groups.

Though not limited thereto only, suitable examples include a 3,5-dimethyl-3',5'-di-t-butyldiphenoquinone, a 3,5-dimethoxy-3',5'-di-t-butyldiphenoquinone, a 3,3'-dimethyl-5,5'-di-t-butyldiphenoquinone, a 3,5'-dimethyl-3', 5-di-t-butyldiphenoquinone, a 3,5,3',5'-tetramethyldiphenoquinone, a 2,6,2',6'-tetra-t-butyldiphenoquinone, a 3,5,3',5'-tetraphenyldiphenoquinone, a 3,5,3',5'-tetracyclohexyldiphenoquinone and the like. These diphenoquinone derivatives are desirable because they have a small mutual action among molecules owing to their low molecular symmetry, and exhibit excellent solubility.

The following compounds have been known as the positive hole-transporting substances. Among them, the compounds having excellent solubility and positive hole-transporting property are used. That is, hydrazone salts such as a pyrene, an N-ethylcarbazoic, an N-isopropylcarbazole, an N-methyl-N-phenylhydrazino-3-methylidyne-9-carbazole, an N,N-diphenylhydrazino-3-methylidyne-9-ethylcarbazoic, an N,N-diphenylhydrazino-3-methylidyne-10-ethylphenothiazine, an N,N-diphenylhydrazino-3-methylidyne-10-ethylphenoxazine, a p-diethylaminobenzaldehyde-N,N-diphenylhydrazone, a p-diethylaminobenzaldehyde-α-naphthyl-N-phenylhydrazone, a p-pyrrolidinobenzaldehyde-N,N-diphenylhydrazone, a 1,3,3-trimethylindolenine-ω-aldehyde-N,N-diphenylhydrazone, and a p-diethylbenzaldehyde-3-methylbenzthiazolinone-2-hydrazone; pyrazolines such as a 2,5-bis(p-diethylaminophenyl)-1,3,4-oxadiazole, a 1-phenyl-3-(p-diethylaminostyryl)-5-(p-diethylaminophenyl) pyrazoline, a 1-[quinonyl(2)]-3-(p-diethylaminostyryl)-5-(p-diethylaminophenyl) pyrazoline, a 1-[pyridyl(2)]-3-(p-diethylaminostyryl)-5-(p-diethylaminophenyl) pyrazoline, a 1-[6-methoxypyridyl(2)]-3-(p-diethylaminostyryl)-5-(p-diethylaminophenyl) pyrazoline, a 1-[pyridyl (3)]-3-(p-diethylaminostyryl)-5-(p-diethylaminophenyl) pyrazoline, a 1-[lepidyl (3)]-3-(p-diethylaminostyryl)-5-(p-diethylaminophenyl) pyrazoline, a 1-[pyridyl (2)]-3-(p-diethylaminostyryl)-4-methyl-5-(p-diethylaminophenyl) pyrazoline, a 1-[pyridyl(2)]-3-(α-methyl-p-diethylaminostyryl)-3-(p-diethylaminophenyl) pyrazoline, a 1-phenyl-3-(p-diethylaminostyryl)-4-methyl-5-(p-diethylami nophenyl) pyrazoline, and spiropyrazoline; oxazole type compounds such as a 2-(p-diethylaminostyryl)-3-diethylaminobenzoxazole, and a 2-(p-diethylaminophenyl)-4-(p-dimethylaminophenyl)-5-(2-chlorophenyl) oxazole; thiazole type compounds such as a 2-(p-diethylaminostyryl)-6-diethylaminobenzothiazole and the like; triarylmethane type compounds such as a bis(4-diethylamino-2-methylphenyl) phenylmethane and the like; polyarylalkanes such as a 1,1-bis(4-N,N-diethylamino-2-methylphenyl) heptane, a 1,1,2,2-tetrakis(4-N,N-dimethylamino-2-methylphenyl) ethane and the like; benzidine type compounds such as an N,N'-diphenyl-N,N'-bis(methylphenyl) benzidine, an N,N'-diphenyl-N,N'-bis(ethylphenyl) benzidine, an N,N'-diphenyl-N,N'-bis(propylphenyl) benzidine, an N,N'-diphenyl-N,N'-bis(butylphenyl) benzidine, an N,N'-bis(isopropylphenyl) benzidine, an N,N'-diphenyl-N,N'-bis(secondary butylphenyl) benzidine, an N,N'-diphenyl-N,N'-bis(tertiary butylphenyl) benzidine, an N,N'-diphenyl-N,N'-bis(2,4-dimethylphenyl) benzidine, and an N,N'-diphenyl-N,N'-bis(chlorophenyl) benzidine; and a triphenylamine, a poly-N-vinylcarbazole, a polyvinylpyrene, a polyvinylanthracene, a poly-9-vinylphenylanthracene, a pyrene-formaldehyde resin and an ethylcarbazoleformaldehyde resin.

Among them, it is desired to use a benzidine type transporting agent and, particularly, a transporting agent represented by the general formula (7)

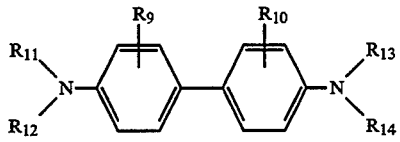

(7)

wherein $R_9$ and $R_{10}$ are lower alkyl groups such as methyl groups or ethyl groups, and $R_{11}$, $R_{12}$, $R_{13}$ and $R_{14}$ are alkyl groups with less than 18 carbon atoms, cycloalkyl groups, aryl groups, alkaryl groups or aralkyl groups, and a carbazolehydrazone type transporting agent and, particularly, a transporting agent represented by the general formula (8)

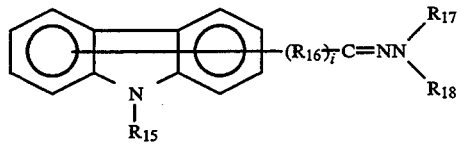

(8)

wherein $R_{15}$ is a hydrogen atom, an alkyl group or an acyl group, $R_{16}$ is a divalent organic group such as an alkylene group, and $R_{17}$ and $R_{18}$ are alkyl groups with less than 18 carbon atoms, cycloalkyl groups, aryl groups, alkaryl groups or aralkyl groups, because of their good solubility and positive hole-transporting property.

In the single dispersion type photosensitive material used in the present invention, the charge-generating agent (CGM) should be contained in the photosensitive layer in an amount of 0.1 to 5% by weight and, particularly, 0.25 to 2.5% by weight with respect to the solid components, the electron-transporting agent should be contained in the photosensitive layer in an amount of 5 to 50% by weight and particularly 10 to 40% by weight with respect to the solid component, and the positive hole-transporting agent should be contained in the photosensitive layer in an amount of 5 to 50% by weight and, particularly, 10 to 40% by weight with respect to the solid component. In this case, it is most desired that the electron-transporting agent and the positive hole-transporting agent are contained at a weight ratio of from 1:9 to 9:1 and, particularly, from 1:8 to 8:2.

The composition for forming the photosensitive material of the present invention may be blended with a variety of known blending agents such as an antioxidizing agent, a radical-trapping agent, a singlet quencher, an ultraviolet ray absorbing agent, a softening agent, a surface reforming agent, a defoaming agent, a filler, a viscosity-increasing agent, a dispersion stabilizer, a wax, an acceptor and a donor within ranges that do not adversely affect the electrophotographic properties.

When a steric hindrance phenol type antioxidizing agent is blended in an amount of 0.1 to 50% by weight relative to the whole solid components, furthermore, the durability of the photosensitive layer can be strikingly improved without adversely affecting the electrophotographic properties.

As the electrically conducting substrate on which the photosensitive layer is to be provided, there can be used a variety of materials having electric conductivity such as metals, e.g., aluminum, copper, tin, platinum, gold, silver, vanadium, molybdenum, chromium, cadmium, titanium, nickel, indium, stainless steel, brass and the like, plastic materials on which the above metals are deposited or laminated, and glasses coated with an aluminum iodide, a tin oxide, an indium oxide or the like oxide.

The photosensitive material of the single layer dispersion type of the present invention does not generate interference fringe, and, hence, uses an ordinary aluminum blank tube and, particularly, a blank tube so treated with alumite as to have a film thickness of from 1 to 50 μm.

The photosensitive material of the type of the single dispersion layer is formed by mixing the charge-generating material, charge-transporting agent and a binder resin by a widely known method such as a roll mill, a ball mill, an attritor, a paint shaker or an ultrasonic wave dispersing machine and, then, applying the mixture by the known application means, followed by drying.

Though there is no particular limitation, the photosensitive layer should have a thickness of, generally, from 5 to 100 μm and, particularly, from 10 to 50 μm.

A variety of organic solvents can be used as a solvent for forming the coating solution, such as alcohols, e.g., methanol, ethanol, isopropanol and butanol; aliphatic hydrocarbons, e.g., n-hexane, octane and cyclohexane; aromatic hydrocarbons, e.g., benzene, toluene and xylene; halogenated hydrocarbons, e.g., dichloromethane, dichloroethane, carbon tetrachloride and chlorobenzene; ethers, e.g., dimethyl ether, diethyl ether, tetrahydrofurane, ethylene glycol dimethyl ether, and diethylene glycol dimethyl ether; ketches, e.g., acetone, methyl ethyl ketone, and cyclohexanone; esters, e.g., ethyl acetate and methyl acetate; dimethylformamide and dimethyl sulfoxide, which may be used in one kind or being mixed in two or more kinds. The coating solution should have a solid component concentration of, usually, from 5 to 50%.

[Transfer of Toner]

To transfer the toner, the transfer roller 14 is impressed with a DC voltage of a polarity opposite to the main charging polarity of the photosensitive layer 10. The DC voltage may be lower than the charge start voltage of the photosensitive material or may be higher than the charge start voltage of the photosensitive material. From the standpoint of transfer efficiency, the latter transfer system is desired. In this case, it is desired to use the aforementioned photosensitive material that can be charged into both polarities. The charge start voltage ($V_{TH}$) of the photosensitive material with respect to the transfer roller 14 varies depending upon the kind of the photosensitive material but is from about 0.3 to about 2 KV in the case of the organic photosensitive material of the type of single dispersion layer that is favorably used in the present invention. From the standpoint of efficiently transferring the toner, the applied voltage should be more than 1.5 times and, particularly, more than 2 times of the charge start voltage ($V_{TH}$) of the photosensitive material.

On the other hand, the upper limit of the voltage applied to the transfer roller is determined by the surface potential of the photosensitive layer 10 (residual potential before the main charging) after it has been discharged. That is, the applied voltage should be so set that the absolute value of the residual potential before the main charging is smaller than 50 V and, preferably, smaller than 20 V.

That is, as pointed out already, the preferred embodiment of the present invention uses a photosensitive material that can be charged into both the positive polarity and the negative polarity. Therefore, when the surface potential after discharged lies within the above-mentioned range despite the polarity is opposite to that of the main charging, it is allowed to homogeneously effect the main charging in the next cycle of forming the image, and image free of unevenness can be formed even from a half-tone document. This also means that the DC voltage (absolute value) applied to the transfer roller 14 is set to be greater than that of the conventional system, in order to improve the toner transfer efficiency.

EXAMPLES

The present invention will be concretely described below.

[Preparation of a Transfer Roller]

A mixture of 100 parts by weight of a polyethylene glycol adipate (average molecular weight, 1820) and 18 parts by weight of a naphthalene-1,5-diisocyanate was stirred at 80° C. for 2 hours to prepare an isocyanate-terminated prepolymer.

The following composition was prepared.

| | |
|---|---|
| Above-mentioned prepolymer | 100 parts by weight |
| 1,4-Butanediol (crosslining agent) | 5 parts by weight |
| Dibutyltin dilaurate (catalyst) | 0.005 parts by weight |
| Carbon black (conducting agent) | 20 parts by weight |

The above components were sufficiently mixed, poured into a mold in which is inserted an electrically conducting core rod, polymerized under the conditions shown in Table 1 below and in FIG. 5, followed by aging to form a transfer roller having a diameter of 15 mm.

[Preparation of a Transfer Roller for Comparison]

Polyisoprene-polybutadiene

The following composition was used for forming a polyisoprene (polybutadiene) rubber.

| | |
|---|---|
| Catalyst: titanium tetrachloride | 15 parts by weight |
| Catalyst: triisobutylaluminum | 15 parts by weight |
| Monomer component: isoprene(butadiene) | 100 parts by weight |
| Solvent: heptane | 400 parts by weight |

The above components were stirred, mixed, and reacted at 50° C. for 22 hours. The obtained polymer solution was poured into a 2-propanol and was reprecipitated. Then, the precipitate was dried under reduced pressure, 100 parts by weight of the obtained composition was melted at 150° C., and 20 parts by weight of carbon black was added thereto as an electric conduction imparting agent. The mixture was stirred to prepare a transfer roller in the same manner as described above.

[Preparation of a Photosensitive Drum]

| (Components) | |
|---|---|
| Metal-free phthalocyanine (charge-generating material) | 5 parts by weight |
| N,N'-Bis(o,p-dimethylphenyl)-N,N'-diphenylbenzidine (positive hole-transporting agent) | 40 parts by weight |
| 3,3'5,5'-Tetraphenyldiphenoquinone (electron-transporting agent) | 40 parts by weight |
| Polycarbonate (binder resin) | 100 parts by weight |
| Dichloromethane (solvent) | 800 parts by weight |

The above components were mixed and dispersed using a paint shaker, and the obtained coating solution was applied onto an aluminum blank tube and was dried with the hot air heated at 60° C. for 60 minutes to prepare a single layer-type photosensitive material drum having a film thickness of 15 μm.

Examples 1 to 7 and Comparative Examples 1 to 7

The transfer roller having the above-mentioned polyurethane rubber (reaction temperature, reaction time and rubber hardness were as shown in Table 1) was disposed maintaining a predetermined distance from the photosensitive material drum (image carrier), held at 50° C. for four days, and, then, a solid image was formed under the conditions described below.

(Developing Method)

The image was formed by the reversal developing under the below-mentioned conditions using an electrophotographic device which comprises, as shown in FIG. 4, the photosensitive drum (image carrier) 6 having the photosensitive layer 10 prepared as described above, surrounded by a corona charger 11 for main charging, an optical system (laser beam) 12 for image exposure, a developer 13 using a two component-type developing agent (positively charged toner), a transfer roller 14 of a rubber shown in Table 1, a light source 15 for discharging, and a device for cleaning residual toner.

[Image Evaluation Conditions]

| | |
|---|---|
| Surface potential of the photosensitive material drum at a portion irradiated with light: | +100 V |
| Developing bias: | +350 V (DC) |
| Transfer roller voltage: | −2.5 KV |
| Gap between transfer roller and photosensitive material drum: | 0.15, 0.2, 0.5, 2.0, 2.1 mm |

[Method of Evaluating White Spots]

A black solid image of an optical reflection density (ID) of about 1.3 was printed, and a difference ΔID between a maximum value and a minimum value of ID was measured.

The difference ΔID increases when the white spots occur.

[Method of Evaluating Transfer Efficiency]

A line chart was printed on 1000 copies, the weight w1 of the toner consumed and the weight w2 of the toner recovered without being transferred onto the transfer material were measured, and the transfer efficiency was found in compliance with the following formula, $$\text{Transfer efficiency} = \frac{w1 - w2}{w1} \times 100$$

The transfer efficiency decreases when the transfer is poor or when solid parts of characters are missing without being completely formed.

TABLE 1

| | Material of transfer roller | Reaction tempera-ture (°C.) | Reaction time (hr) | Rubber hardness* (JIS A) (mm) | Gap between roller and drum | Δ ID | Transfer efficency (%) |
|---|---|---|---|---|---|---|---|
| Example 1 | polyurethane | 200 | 2 | 70° | 0.5 | 0.018 | 90.6 |
| Example 2 | polyurethane | 150 | 4 | 71° | 0.5 | 0.015 | 91.0 |
| Example 3 | polyurethane | 150 | 2 | 61° | 0.5 | 0,023 | 90.7 |
| Example 4 | polyurethane | 100 | 4 | 61° | 0.5 | 0.026 | 89.7 |
| Example 5 | polyurethane | 200 | 0.8 | 50° | 0.5 | 0.035 | 89.5 |
| Comparative Example 1 | polyurethane | 200 | 0.5 | 41° | 0.5 | 0.135 | 88.9 |
| Comparative Example 2 | polyurethane | 100 | 1 | 47° | 0.5 | 0.112 | 89.1 |
| Comparative Example 3 | polyurethane | 200 | 1.5 | 49. | 0.5 | 0.120 | 90.0 |
| Example 6 | polyurethane | 150 | 2 | 61° | 0.2 | 0.026 | 85.3 |
| Example 7 | polyurethane | 150 | 2 | 61° | 2.0 | 0.042 | 84.6 |
| Comparative Example 4 | polyurethane | 150 | 2 | 61° | 0.15 | 0.028 | 80.6 |
| Comparative Example 5 | polyurethane | 150 | 2 | 61° | 2.1 | 0.055 | 79.5 |
| Comparative Example 6 | polyisoprene | 50 | 22 | 61° | 0.5 | 0.034 | 77.6 |
| Comparative Example 7 | polybutadiene | 50 | 22 | 61° | 0.5 | 0.049 | 76.9 |

*Rubber hardness is that of when no electric conduction imparting agent (carbon) is added.

We claim:

1. A transfer device in an image-forming apparatus which has an image carrier and a transfer roller, and permits a transfer material to pass therethrough so that the toner on the image carrier is transferred onto the transfer material, wherein said image carrier is an organic photosensitive material containing a charge-generating agent and a charge-transporting agent, said transfer roller is made of an electrically conducting polyurethane rubber composition which is so cured as to exhibit a rubber hardness of higher than 50° (JIS A), and said image carrier and said transfer roller are disposed being spaced apart maintaining a small gap which is greater than the thickness of the transfer material enabling the toner to be transferred onto the transfer material.

2. A transfer device according to claim 1, wherein said small gap is from 0.2 to 2 mm.

3. A transfer device according o claim 1, wherein said transfer roller is made of a polyurethane rubber composition which is so cured as to exhibit a rubber hardness of 70° (JIS A) or higher.

* * * * *